US009498864B2

(12) United States Patent
Yu et al.

(10) Patent No.: US 9,498,864 B2
(45) Date of Patent: Nov. 22, 2016

(54) METHOD FOR GRINDING SPRING WITH HIGH QUALITY AND HIGH EFFICIENCY

(71) Applicant: ZHEJIANG JIADU SPRING MACHINE CO., LTD., Shaoxing (CN)

(72) Inventors: Jialin Yu, Shaoxing (CN); Du Yu, Shaoxing (CN); Huali Huang, Shaoxing (CN)

(73) Assignee: ZHEJIANG JIADU SPRING MACHINE CO., LTD., Shaoxing (CN)

( * ) Notice: Subject to any disclaimer, the term of this patent is extended or adjusted under 35 U.S.C. 154(b) by 0 days.

(21) Appl. No.: 15/187,783

(22) Filed: Jun. 21, 2016

(65) Prior Publication Data

US 2016/0297047 A1 Oct. 13, 2016

Related U.S. Application Data

(63) Continuation of application No. PCT/CN2014/078069, filed on May 22, 2014.

(30) Foreign Application Priority Data

Dec. 31, 2013 (CN) ..... 2013 1 0753809
Dec. 31, 2013 (CN) ..... 2013 1 0753820
Dec. 31, 2013 (CN) ..... 2013 2 0892681 U

(51) Int. Cl.

| | |
|---|---|
| ***B24B 7/17*** | (2006.01) |
| ***B24B 7/16*** | (2006.01) |
| ***B24B 41/04*** | (2006.01) |
| ***B24B 41/047*** | (2006.01) |
| ***B24B 41/06*** | (2012.01) |
| ***B24B 47/00*** | (2006.01) |

(52) U.S. Cl.

CPC ..... *B24B 7/167* (2013.01); *B24B 7/162* (2013.01); *B24B 7/17* (2013.01); *B24B 41/04* (2013.01); *B24B 41/047* (2013.01); *B24B 41/067* (2013.01); *B24B 47/00* (2013.01)

(58) Field of Classification Search

CPC ..... B24B 7/167; B24B 7/162; B24B 7/17; B24B 41/04; B24B 41/067; B24B 47/00
USPC ..... 451/1, 5, 67, 261, 262, 51, 57, 58, 652
See application file for complete search history.

(56) References Cited

U.S. PATENT DOCUMENTS

| | | | | |
|---|---|---|---|---|
| 1,763,820 | A * | 6/1930 | Rodemeyer | B24B 7/167 451/261 |
| 3,393,473 | A * | 7/1968 | Rimmer | B24B 7/167 451/261 |
| 4,217,734 | A * | 8/1980 | Frei | B24B 49/02 451/22 |
| 4,358,912 | A * | 11/1982 | Shigeru | B24B 7/167 451/22 |
| 2013/0303058 | A1* | 11/2013 | Mahler | B24B 7/167 451/119 |
| 2015/0298277 | A1* | 10/2015 | Jung | B24B 7/167 451/57 |

* cited by examiner

*Primary Examiner* — Robert Rose
(74) *Attorney, Agent, or Firm* — Wayne & King LLC

(57) ABSTRACT

Disclosed is a method for grinding a spring with high quality and high efficiency, comprising the steps as follows: firstly, at least one of an upper grinding wheel (1) and a lower grinding wheel (2) is configured to comprise an inner grinding wheel (21) and an outer grinding wheel (24), wherein the inner grinding wheel (21) is fitted in the outer grinding wheel (24); the inner grinding wheel (21) or the outer grinding wheel (24) is driven by a transmission mechanism, the inner grinding wheel (21) and the outer grinding wheel (24) rotating in opposite directions; after a complete spring is fed to a space between the upper grinding wheel (1) and the lower grinding wheel (2), the complete spring is moved back and forth in the plane of the grinding wheels; and then the upper grinding wheel (1) is moved downwardly such that two end faces of the spring are ground by the grinding wheels, and when the height of the ground spring meets the requirement, the upper grinding wheel (1) is stopped moving downwardly and is returned to the original point later. Then, the ground spring movement is stopped and it is moved away from the space between the two grinding wheels, i.e., the complete spring is removed. In this way, the spring is ground in a revolving state, which can improve the yield and quality of ground springs, save energy and protect the environment, and result in a low cost of grinding, a simple structure, low cost for manufacturing parts, long persistence in precision of mechanisms, and good stability.

8 Claims, 8 Drawing Sheets

B — B

METHOD FOR GRINDING SPRING WITH HIGH QUALITY AND HIGH EFFICIENCY

CROSS-REFERENCE TO RELATED APPLICATIONS

This application is a continuation of International Patent Application No. PCT/CN2014/078069 with a filing date of May 22, 2014, designating the United States, now pending, and further claims priority to Chinese Patent Application No. 201310753809.7 with a filing date of Dec. 31, 2013, No. 201310753820.3 with a filing date of Dec. 31, 2013 and No. 201320892681.8 with a filing data of Dec. 31, 2013. The content of the aforementioned applications, including any intervening amendments thereto, are incorporated herein by reference.

TECHNICAL FIELD

The present invention relates to the field of spring grinding, and in particular to a method for grinding a spring with high quality and, high efficiency.

BACKGROUND OF THE PRESENT INVENTION

Currently, the basic mechanisms of numerical control dual-end face spring grinders comprise an upper grinding wheel 01 and a lower grinding wheel 02, as shown in schematic views in FIGS. 1 and 2. The upper grinding wheel 01 can be moved up and down. A grinding disc 03, which is intended to contain springs 04, is provided in the space between the two end faces of the grinding wheels, and the grinding disc 03 is rotated around a fixed shaft. The spring grinder follows the basic working principle below: the grinding disc 03 is rotated around a fixed shaft, and as a result, the springs 04 on the grinding disc 03 are driven by the rotation of the grinding disc 03, and enter into the space between the two end faces of the grinding wheels from point a, and pass through point b to reach to point c, and get out of the space between the two end faces of the grinding wheels; then the springs 04 continue to be driven by the rotation of the grinding disc 03, and pass through point d from point c to reach to paint a once more; and the cycle is continued. During the whole process in which the springs 04 are driven by the grinding disc 03, the upper grinding wheel 01 is moved down slowly and the two end faces of the springs 04 in the space between the two end faces of the grinding wheels are ground. When the upper grinding wheel 01 is moved downwardly to the extent that the length of the ground spring 04 meets the requirement, the upper grinding wheel 01 is stopped moving and is then returned to the original point, and the grinding disc 03 is also rotated slowly. At this point, the operator opens the spring door, and then the ground springs 04 are removed out of the opening of the spring door one by one. After all the springs 04 are removed, the spring door is closed. Another complete spring 04 is placed onto the grinding disc 03 for the next grinding.

This working principle is suffered from the following disadvantages:

First, angle β is generally of 60 to 70 degrees, so that when the upper grinding wheel is moved downwardly, the time taken for the spring at point a on the grinding disc to pass through point b from point a to reach to point cis only about 17% of the time taken for the grinding disc to rotate in a full circle. Therefore, this results in three consequences: 1), Only about 17% of the complete spring is ground in the plane of the grinding wheels simultaneously, which leads to a low production efficiency. 2), The amount of grinding of each spring is only 17% of the amount of downward moving of the upper grinding wheel when the grinding disc is rotated in a full circle, while for the remaining 83% of the amount of moving, the spring is actually external to the grinding wheel and is not ground, which is unreasonable. The consequence of this is that the grinding at point a of the grinding wheel is very fast due to the sudden increase of the amount of grinding at point a, while the grinding at point b is slow and point c is almost not ground. Thus, the end face of the grinding wheel finally takes the shape of a truncated cone as shown in FIG. 3, which seriously affect the vertical precision of the spring grinding. 3), when the two grinding wheels are grinding, only the position coincident with the grinding disc is subjected to a force, and the amount of grinding at point a of the grinding wheels is very large, i.e., the primary grinding force is exerted on point a. The resultant axial force composed of the axial components of the grinding force is far away from the center line of the grinding wheel shaft. Therefore, the grinding wheel shaft and the grinding wheel disc have to bear a large bending moment, resulting in a large geometric deformation which is particularly obvious for the heavily ground spring, thus seriously affecting the precision of the spring grinding.

Second, because the grinding wheels are uneven when grinding, the end faces of the spring are actually not perpendicular to the plane of the spring axis, therefore, the spring cannot be brought to revolve in the whole process of grinding from point a to point c, which results in a low precision of the spring after being ground.

Finally, because there is no structure in the spring grinder for automatically regulating the interference of the bearing supporting the grinding wheel shaft currently, the precision and stability of the apparatus will degrade after being used for a period of time. To keep the precision and stability of the spring grinding, highly skilled workers are often required to manually regulate the interference of the bearing. In this way, not only such skilled workers are hard to find, but also the regulating to the interference of the bearing is troublesome.

In summary, currently, there is a need for innovation in both the working principle and the structure of the numerical control spring grinder whether seen from the point of apparatus structure and quality of the ground spring or from the point of grinding and production efficiency.

To this end, a further study is made by the present inventor to develop a method for grinding a spring with high quality and high efficiency from which the present application comes into being.

SUMMARY OF PRESENT INVENTION

The objective of the present invention is to provide a method for grinding a spring with high quality and high efficiency which can improve the quality and yield of ground springs, save energy and protect the environment, and result in a low cost of grinding, low cost for manufacturing parts, long persistence in precision of mechanisms, and good stability.

To achieve the above objective, the present invention provides the following technical solutions:

A method for grinding a spring with high quality and high efficiency, comprising the steps as follows:

Firstly, at least one of an upper grinding wheel and a lower grinding wheel is configured to comprise an inner grinding wheel and an outer grinding wheel, wherein the inner grinding wheel is fitted in the outer grinding wheel; the inner grinding wheel or the outer grinding wheel is driven by a transmission mechanism, the inner grinding wheel and the outer grinding wheel rotating in opposite directions; after a complete spring is fed to a space between the upper grinding wheel and the lower grinding wheel, the complete spring is moved back and forth in the plane of the grinding wheels; at the same time, the grinding wheels are fed and then withdrawn after the spring is well ground; then, the ground spring movement is stopped and it is moved away from the space between the two grinding wheels, and finally the complete spring is removed.

Further, the spring is moved back and forth in the plane of the grinding wheels by means of a swinging and moving combined mechanism that comprises a worm linked with a motor, wherein two worm wheels are provided on both sides of the worm, the worm wheel being linked with a carriage shaft, and a slider shaft is provided on the carriage shaft, the slider shaft being linked with a linkage A that is connected with a grinding disc, the spring being loaded within the grinding disc, and the distance between the shaft axis of the slider shaft and the shaft axis of the carriage shaft can be regulated.

Further, the two carriage shafts of the swinging and moving combined mechanism are driven by the two worm wheels, and the two worm wheels are transmitted by the same worm; or the two carriage shafts of the swinging and moving combined mechanism are driven by two gears, and the gears are transmitted by a same gear shaft.

Further, the upper grinding wheel comprises an inner grinding wheel and an outer grinding wheel, and the lower grinding wheel has art integral structure; or the lower grinding wheel comprises an inner grinding wheel and an outer grinding wheel, and the upper grinding wheel has an integral structure; or both the lower grinding wheel and the upper grinding wheel comprise an inner grinding wheel and an outer grinding wheel, and with this structure, both inner grinding wheels are rotated in the same direction and both outer grinding wheels are also rotated in the same direction, but the inner grinding wheels and the outer grinding wheels are rotated in opposite directions.

Further, the complete spring is fed to a space between the upper grinding wheel and the lower grinding wheel by means of the swinging and moving combined mechanism, and the swinging and moving combined mechanism is configured to comprise a support that is linked with a turntable by a linkage B, one end of the linkage B being provided at the edge of the turntable by a shaft pin.

Further, the transmission mechanism comprises a belt pulley that is linked with the motor and a grinding wheel shaft that can be rotated with the belt pulley, the grinding wheel shaft being fixedly connected with the inner grinding wheel or the outer grinding wheel.

Further, the inner grinding wheel shaft of the inner grinding wheel is fitted in the outer grinding wheel shaft of the outer grinding wheel with a tapered roller bearing provided between them, and the outer grinding wheel shaft is provided in a bearing sleeve with a tapered roller bearing provided between them as well, and the tapered roller bearing is configured to have a U-shaped spring washer on the end face of its outer ring, the contact surface between the U-shaped spring washer and the tapered roller bearing is of an arc shape.

Further, the upper grinding wheel is linked with the motor shaft by an upper coupling and a lower coupling, a coupling plate being provided between the upper coupling and the lower coupling, and the edge of the coupling plate is quartered by four notches.

By employing the above technical solutions, the present invention achieves the following advantages compared to the prior art:

First, high production efficiency, which is resulted from: firstly, the complete spring is ground in the plane of the grinding wheels simultaneously; and secondly, at least one of the grinding wheels is configured to comprise an inner grinding wheel and an outer grinding wheel which are rotated in opposite directions, such that the spring can be ground in a revolving state. Thus, a great feeding amount of grinding can be performed. As a result, the production efficiency will be about twice that of the current numerical control spring grinder.

Second, high verticality precision of grinding and high stability, which is resulted from: 1, The spring is moved back and forth in the plane of the grinding wheels from the inner diameters to the outer diameters of the grinding wheels, so every point on the grinding wheels is involved in grinding each spring and subjected to equal amount of grinding, such that the grinding wheels are worn uniformly, improving the precision of grinding and stability. 2, At least one of the grinding wheels is configured to comprise an inner grinding wheel and an outer grinding wheel, such that the spring can be ground in a revolving state.

Finally, because the present mechanism includes a mechanism having the combination of the two technical features described above, new technical features are formed by combining the two technical features. The new technical features enable every point on the end faces of the spring to be ground by every point on the grinding wheels, and the grinding wheels are worn particularly uniformly. As a result, the grinding wheels need not to be trimmed and cut from being newly used until being worn out, and the plane of the grinding wheels will always keep a high planarity. Therefore, the verticality precision of grinding and the stability are greatly improved.

Third, saving energy and protecting the environment as well as achieving a low cost of grinding: 1, Low energy consumption, which is resulted from: the spring is ground in a revolving state, and the texture directions of the end faces of the spring vary constantly during grinding, thus heat on the grinding surface is dissipated fast and not apt to be gathered. As a result, the spring is invulnerable to be burned and is easy to be ground, thus reducing the power consumption. 2, Improved working environment and low cost of grinding, which is resulted from: when grinding the spring, the grinding wheels are worn particularly uniformly and need not to be trimmed and cut from being newly used until being worn out. The troublesome problem that the grinding wheels are required to be trimmed and cut constantly for the current numerical control spring grinder when it is grinding springs having a steel wire diameter of above 3 mm is solved. As a result, the utilization of the grinding wheels as well as the working environment for the operators are improved, at the same time, the cost of grinding is reduced.

Fourth, achieving, a simple structure low cost of manufacturing: the grinding disc is mounted on the linkage of the swinging and moving combined mechanism, and the complete spring is swung into and out of the space between the two end faces of the grinding wheels by means of a support 71 in the swinging and moving combined mechanism (the support is mounted in the lower plane of the gearbox) that is linked with a turntable by a linkage B, one end of the linkage B passing through the shaft pin at the edge of the turntable. The motor is decelerated, and the turntable is driven to rotate by the output shaft and the flat key, causing the linkage B to make a planar motion by the shaft pin and the bearing. Then the gearbox that is rotated around a pendulum shaft (the gearbox being mounted on the pendulum shaft) is swung back and forth, enabling the complete spring to swing into and out of the space between the two end faces of the grinding wheels. The grinding disc is designed such that as long as it is dwelled in swinging-in and swinging-out positions, the linkage A, point C and the center point of the turntable are exactly collinear. In this way, when the point of linkage A is rotated with the turntable to be close to point A or point C, substantially no swinging is happened to the gearbox, i.e., very little swinging is happened, which results in little offset between the center of the grinding disc and the center of the grinding wheels. The design is considered to meet the requirement of the ground spring or the requirement that the grinding disc is swung out to the removing position of the spring. The advantages of this design are as follows: 1, Common motors which are less costly and easily controlled can be selected and used, only if the grinding disc is dwelled in swinging-in or swinging-out positions when the motor is started or stopped, such that A, C and O are collinear, at which time, the gearbox cannot be pushed to swing by the resultant moment generated by the grinding forces of the spring to push the box to swing. With above technical features, the grinding disc can be kept at the desired position when the spring is ground. 2, The turntable is configured to have four shaft pin holes thereon which are different from one another in radius dimensions by about 0.2 mm, such that when the grinding disc is swung into the space between the two grinding wheels and the shaft axes of two slider shafts are adjusted to be collinear with the shaft axes of their matching carriage shafts of the swinging and moving combined mechanism, the center line of the grinding disc is substantially coincide with the center line of the grinding wheels. In this way, a mechanism for continuously regulating the magnitude of the swinging angle is not necessary and the usage requirement can be met. Therefore, a simple structure is achieved and the cost of manufacturing is reduced.

Fifth, long persistence in precision of mechanisms and good stability, which is resulted from: the tapered roller bearing that supports the grinding wheel shaft is configured to have a U-shaped spring washer on the end face of its outer ring, and the U-shaped spring washer is equivalent to a spring that can be deformed axially and has a large elastic rigidity. The advantages of this design are as follows: when the mechanisms are mounted and after the interference of the tapered roller bearing is well regulated, to keep the original interference of the tapered roller bearing, the U-shaped spring washer pushes the outer ring of the bearing to axially move in order to automatically compensate the wear of the bearing during the use of the mechanisms as the tapered roller bearing is definitely to be worn, achieving the automatic regulation of the interference of the bearing. As a result, the characteristics of long persistence in precision of mechanisms and good stability are achieved.

Figure 1:
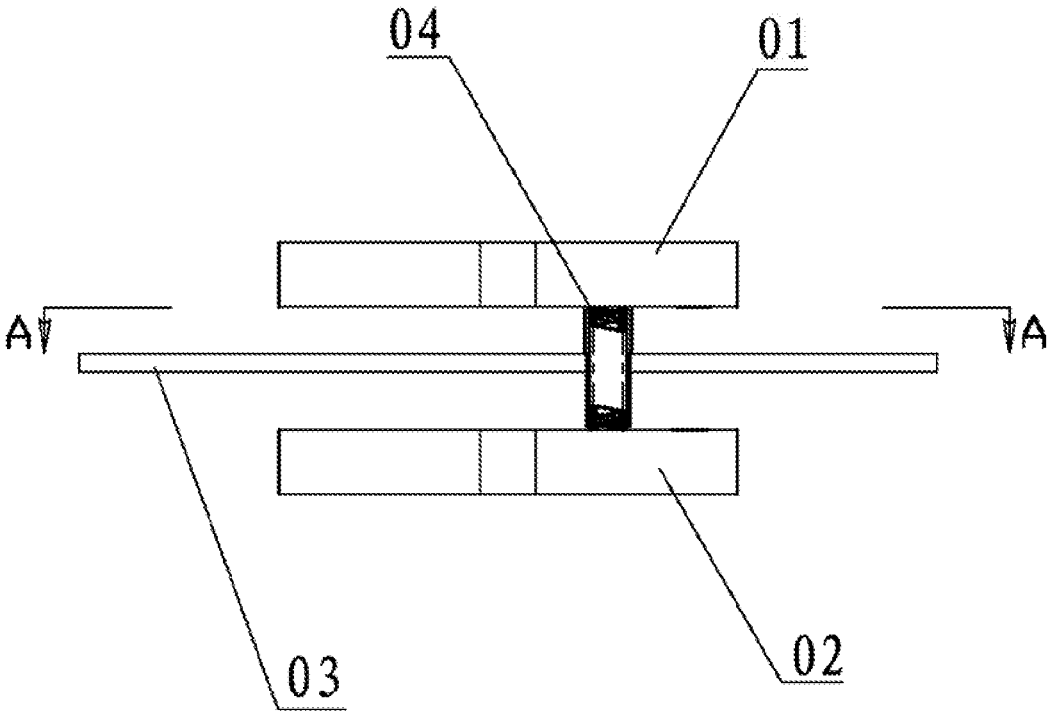
FIG. 1 is a simplified schematic view of the structure of a prior art numerical control spring grinder.
Figure 2:
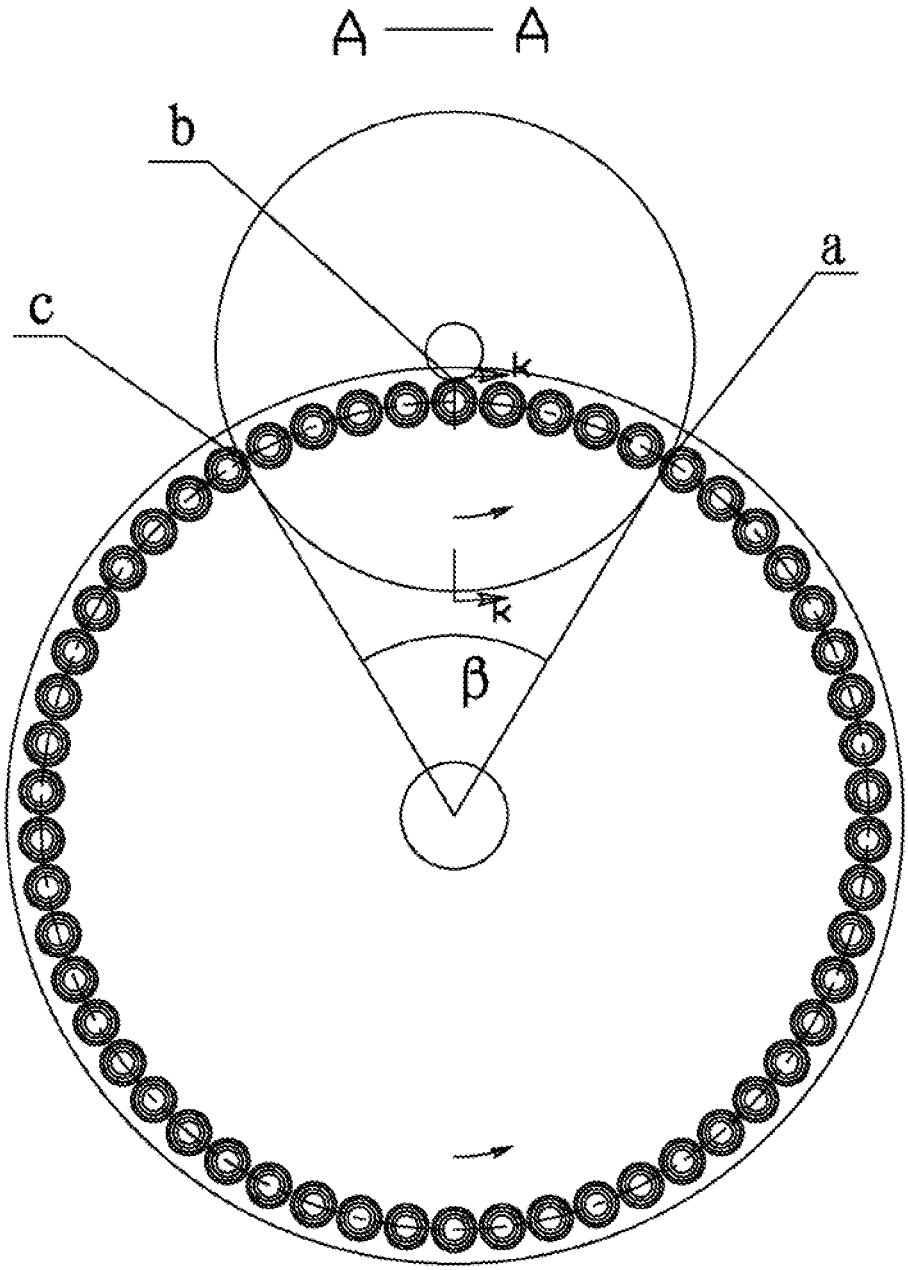
FIG. 2 is a view of FIG. 1 in the A-A direction.
Figure 3:
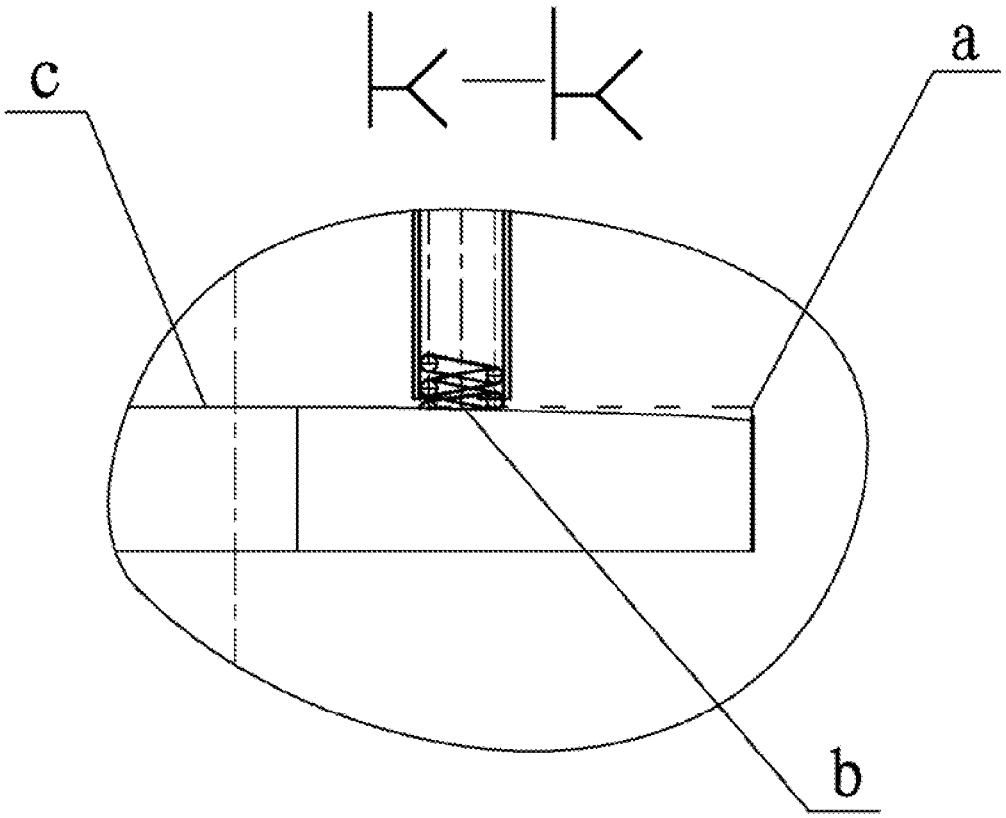
FIG. 3 is a rotated view of FIG. 2 in the K-K direction.
Figure 4:
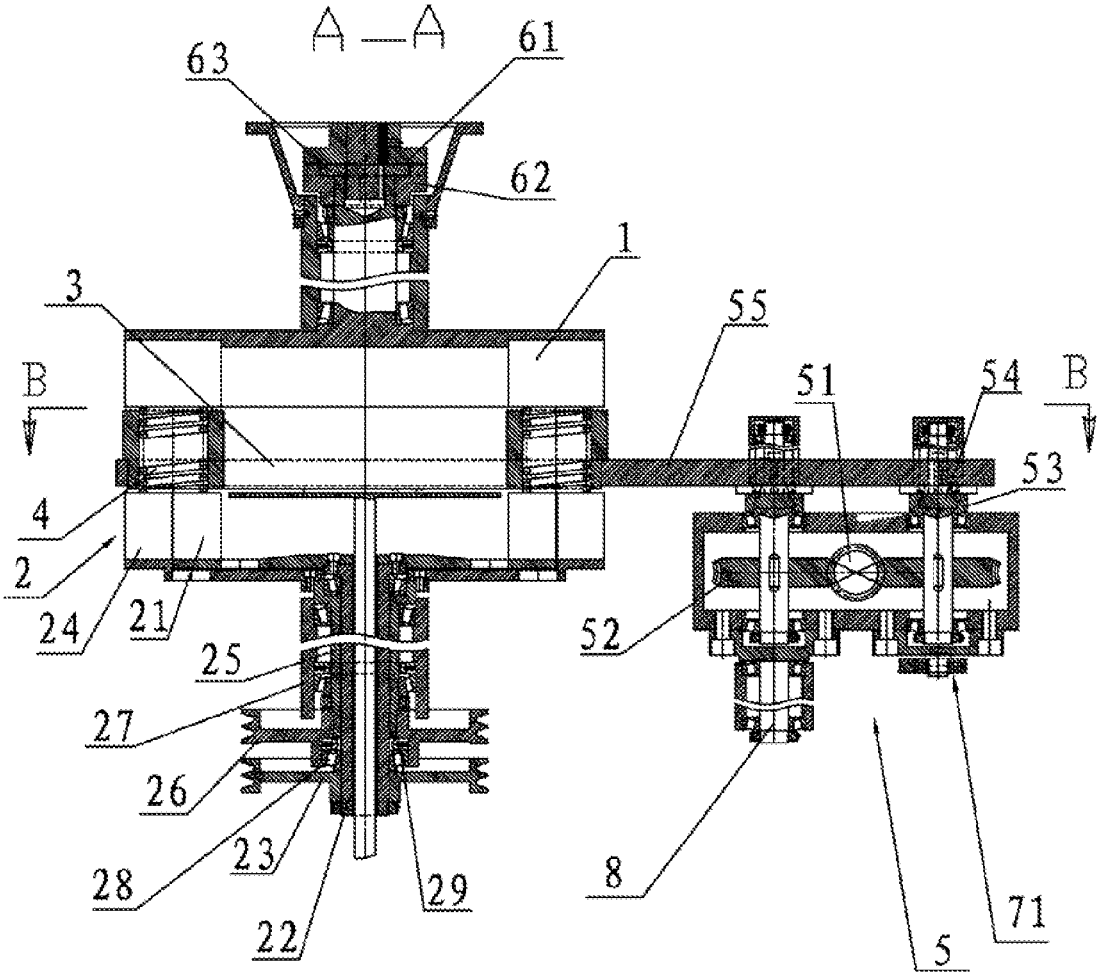
FIG. 4 is a schematic view of the structure of the present invention.
Figure 5:
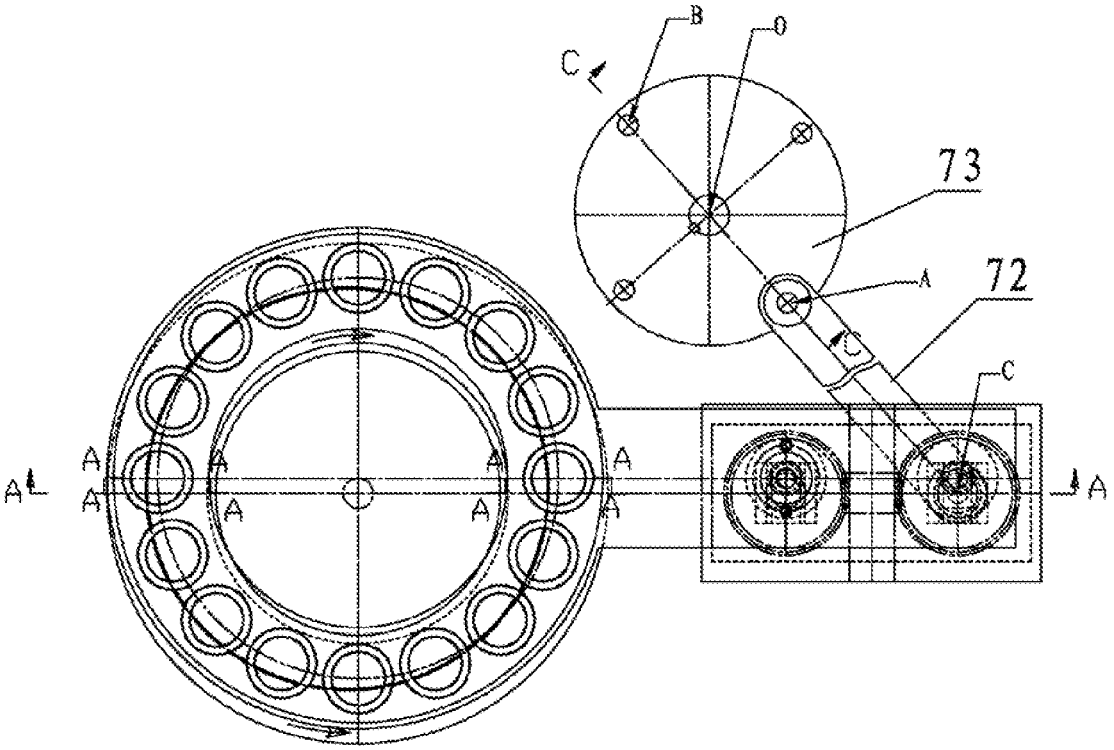
FIG. 5 is a schematic view of FIG. 4 in the B-B direction.

DESCRIPTION OF THE REFERENCE NUMBERS OF THE ACCOMPANYING DRAWINGS upper grinding wheel 1, lower grinding wheel 2, inner grinding wheel 21, inner grinding wheel shaft 22, inner belt pulley 23, outer grinding wheel 24, outer grinding wheel shaft 25, outer belt pulley 26, bearing sleeve 27, tapered roller bearing 28, U-shaped spring washer 29, grinding disc 3, spring 4, swinging and moving combined mechanism 5, worm 51, worm wheel 52, carriage shaft 53, slider shaft 54, linkage A55, upper coupling 61, lower coupling 62, coupling plate 63, support 71, linkage B72, turntable 73, pendulum shaft 8.

DETAILED DESCRIPTION OF PREFERRED EMBODIMENTS

The present invention is further illustrated below in connection with the accompanying drawings and specific embodiments.

As shown in the figures, a method and mechanism for grinding a spring is disclosed in the present invention. The mechanism comprises an upper grinding wheel 1 and a lower grinding wheel 2, and at least one of said upper grinding wheel and said lower grinding wheel 2 comprises an inner grinding wheel 21 and an outer grinding wheel 24. In the present embodiment, the upper grinding wheel 1 is selected to have an integral structure, while the lower grinding wheel 2 comprises the inner grinding wheel 21 and the outer grinding wheel 24, wherein the dimension of the outer diameter of the inner grinding wheel 21 is slightly less than the dimension of the inner diameter of the outer grinding wheel 24, and the inner grinding wheel 21 is fitted in the outer grinding wheel 24. The inner grinding wheel 21 and the outer grinding wheel 24 are rotated in opposite directions, and the outer grinding wheel 24 and the upper grinding wheel 1 are rotated in the same direction. The dimensions of the outer diameters of the upper grinding wheel 1 and the outer grinding wheel 24 are same, and the dimensions of the inner diameters of the upper grinding wheel 1 and the inner grinding wheel 21 are same. A tray is mounted in the inner hole of the lower grinding wheel 2 for holding the spring when it is moved into and out of the space between the two grinding wheels.

A grinding disc 3 is mounted on the linkage of a swinging and moving, combined mechanism 5, and springs are loaded on said grinding disc 3. The complete spring 4 is swung into and out of the space between the two end faces of the grinding wheels by means of a support 71 in the swinging and moving combined mechanism 5 (the support 71 is mounted in the lower plane of the gearbox, i.e., the housing of the swinging and moving combined mechanism 5) that is linked with a turntable 73 by, a linkage 872, one end of the linkage 872 passing through the shaft pin at the edge of the turntable 73. When in use, the motor is decelerated, and the turntable 73 is driven to rotate by the output shaft and the flat key, causing the linkage 872 to make a planar motion by the shaft pin and the bearing. Then the gearbox that is rotated around a pendulum shaft 8 (the gearbox being mounted on the pendulum shaft 8) is swung back and forth, enabling the complete spring to swing into and out of the space between the two end faces of the grinding wheels. The grinding disc 3 is designed such that as long as it is dwelled in swinging-in and swinging-out positions, the linkage A55, point C and the center point O of the turntable 73 are exactly collinear. In this way, when the point of linkage A55 is rotated with the turntable 73 to be close to point A or point C, substantially no swinging is happened to the gearbox, i.e., very little swinging is happened, which results in little offset between the center of the grinding disc 3 and the center of the grinding wheels. The design is considered to meet the requirement of the ground spring or the requirement that the grinding disc is swung out to the removing position of the spring. The advantages of this design are as follows: 1, Common motors which are less costly and easily controlled can be selected and used, only if the grinding disc 3 is dwelled in swinging-in or swinging-out positions when the motor is started or stopped, such that A, C and O are collinear, at which time, the gearbox cannot be pushed to swing by the resultant moment generated by the grinding forces of the spring to push the box to swing. With above technical features, the grinding disc 3 can be kept at the desired position when the spring is ground. 2, The turntable 73 is configured to have four shaft pin holes thereon which are different from one another in radius dimensions by about 0.2 MM, such that when the grinding disc 3 is swung into the space between the two grinding wheels and the shaft axes of two slider shafts 54 are adjusted to be collinear with the shaft axes of their matching carriage shafts 53 of the swinging and moving combined mechanism 5, the center line of the grinding disc 3 is substantially coincide with the center line of the grinding wheels. In this way, a mechanism for continuously regulating the magnitude of the swinging angle is not necessary and the usage requirement can be met. Therefore, a simple structure is achieved and the cost of manufacturing is reduced.

Said ground spring is moved back and forth in the plane of the grinding wheels by means of the swinging and moving combined mechanism 5 that comprises a worm 51 that is linked with the motor, wherein two worm wheels 52 are provided on both sides of the worm 51, said worm wheel 52 being linked with a carriage shaft 53, and a slider shaft 54 is provided on said carriage shaft 53, said slider shaft 54 being linked with a linkage A55. After the two slider shafts 54 are linked with the linkage, the distance between the two slider shafts 54 is the same as the distance between the two carriage shafts 53. The linkage A55 is connected with the grinding disc 3 and the spring is loaded within said grinding disc 3. During installation and adjustment of the mechanism, the center of the grinding disc 3 is aligned with the rotatory center line of the grinding wheels when the shaft axes of the slider shafts 54 are coincide with the shaft axes of the carriage shafts 53. Before grinding the spring, certain regulation is made based on the spring parameters. Generally, the shaft axes of the slider shafts 54 are regulated to be not coinciding with the shaft axes of the carriage shafts 53, and the distances between their centers are the crank lengths. Two crank lengths should be regulated to be equal. When in work, the worm 51 is driven to rotate by the rotation of the motor, and the shafts of the two worm wheels 52 are driven to rotate in the same direction by the worm 51. Then the two slider shafts 54 matching with the carriage shafts 53 rotate eccentrically, causing the linkage that is linked with the two slider shafts 54 to make a planar motion. In this way, every point on the grinding disc 3 is moved in a circle whose radius is equal to the crank length, and the rotatory center line of the spring is also moved in such a circle. Therefore, after the spring is ground, the ground spring is moved back and forth in the plane of the grinding wheels.

Figure 8:
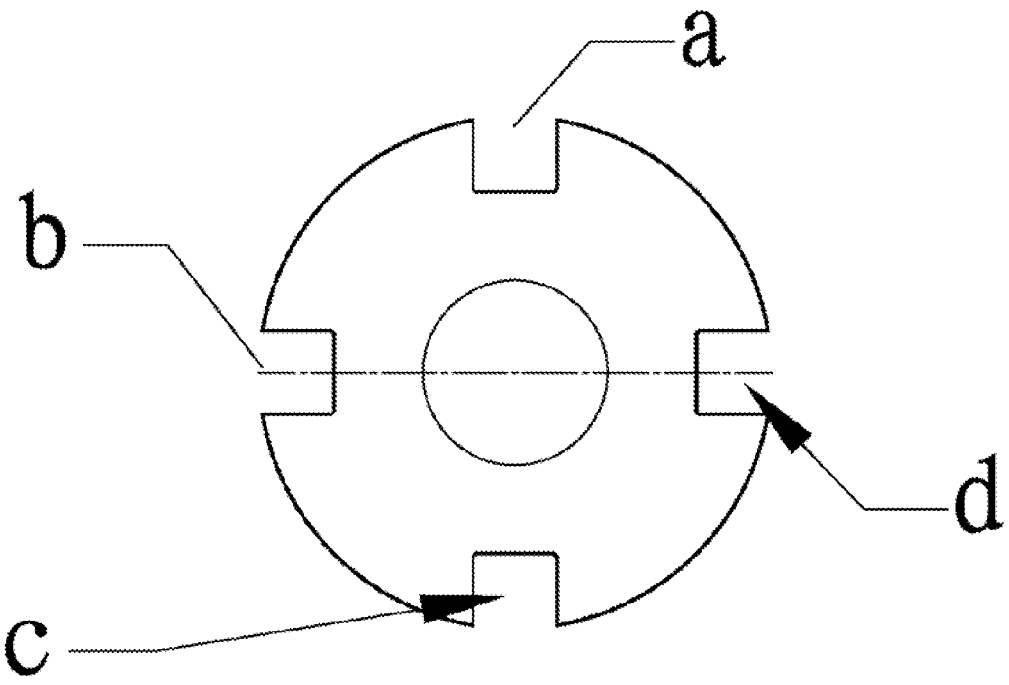
FIG. 8 is a schematic view of a coupling plate.

Said upper grinding wheel 1 is linked with the motor shaft by a upper coupling 61 and a lower coupling 62, and a coupling plate 63 is provided between the upper coupling 61 and the lower coupling 62. The edge of said coupling plate 63 is quartered by four notches. As shown in FIG. 8, the advantages of this design are as follows: firstly, it is convenient for the motor to be mounted and linked without causing vibration and rapid wear of the parts due to the misalignment between the motor shaft and the grinding wheel shaft. Secondly, a good mechanical performance is achieved. During the transmission, the forces exerted on recesses a and c are equal in magnitudes and opposite in directions, which are equivalent to a rotating couple with respect to the center of the shaft. Similarly, the forces exerted on recesses b and d are also equal in magnitudes and opposite in directions, which are also equivalent to a couple with respect to the center of the shaft. They are only two couples which act on the same plane and have opposite directions. Therefore, the coupling plate 63 is not subjected to the turning moment of the rotatory center line in the plane of the figure, which is different from the Oldham coupling which bears a turning moment. Therefore, this coupling plate 63 has a good mechanical performance, high transmission efficiency and large transmission force per unit volume. To this end, the axial dimension and accordingly the outer diameter of the coupling plate 63 can be made small. Finally, an actually small rotatory inertia and high speed transmission are achieved, i.e., the motor is linked to perform the transmission directly, resulting in high efficiency and long lifetime.

Figure 6:
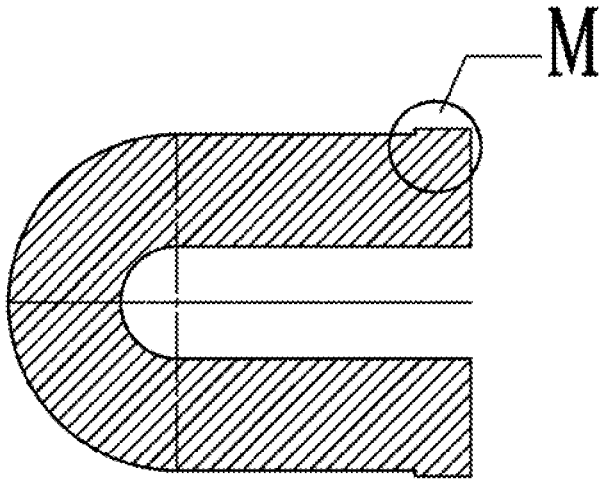
FIG. 6 is a schematic view of a U-shaped spring washer.
Figure 6:
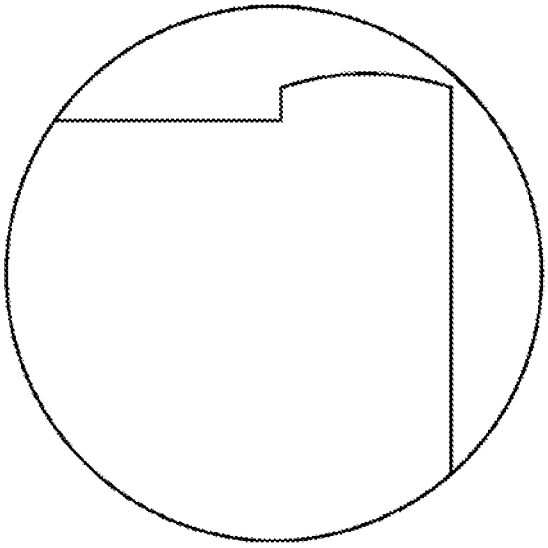
Figure 7:
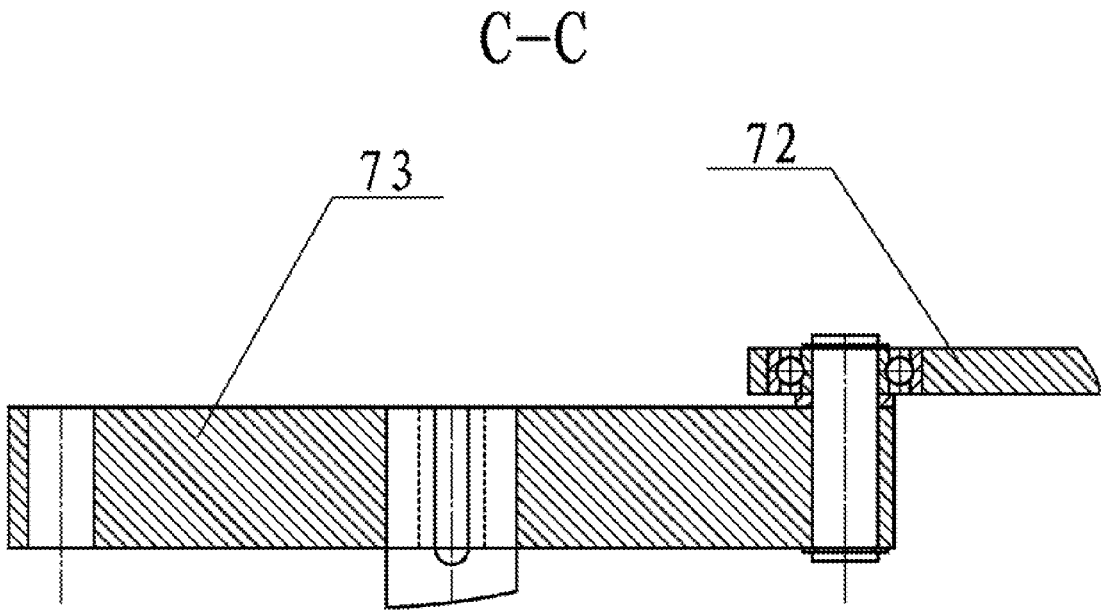
FIG. 7 is a schematic view of FIG. 5 in the C-C direction.

The inner grinding wheel shaft 22 of said inner grinding wheel 21 is fitted in the outer grinding wheel shaft 25 of the outer grinding wheel 24, and a tapered roller bearing 28 is provided between them. The inner grinding wheel shaft 22 is driven to rotate by the inner grinding wheel 21 through an inner belt pulley 23. The outer grinding wheel shaft 25 is provided in an outer belt pulley 27 and is rotated in the same way. A tapered roller bearing 28 is also provided between the outer belt pulley 27 and the outer grinding wheel shaft 25. The tapered roller bearing 28 is also configured to have a U-shaped spring washer 29 on the end face of its outer ring. Firstly, a groove is formed across the outer diameter of the U-shaped spring washer 29 and the bottom of the groove is designed to have a circular arc shape. The advantages of this design are that when the interference is regulated, the U-shaped spring washer 29 can have certain deformation as well as a large elastic rigidity. And when the interference of the tapered roller bearing 28 is automatically regulated, the spring force may change a little. The bottom of the groove is designed into a circular arc, such that the concentration of stress is avoided and no quenching crack will be generated. At the same time, the machining technology is improved. Secondly, the U-shaped spring washer is designed to contact with the outer belt pulley 27 and the tapered roller bearing 28 in the form of large circular arc shapes instead of planes (seen in FIG. 6), because of the deformation of the U-shaped spring washer in the practical application. In other words, actually, the form in which the end face of the U-shaped spring washer is contact with those of the outer belt pulley 27 and the tapered roller bearing 28 cannot be designed to be exactly in planes. Thus, large circular arc shapes are employed to achieve a line contact, and the contact line is a circle whose actual parameters such as the contact stress and strain can be calculated accurately.

The working principle of the present application is as follows: the upper grinding wheel and the lower grinding wheel 2 are rotated, as a result, the complete spring is swung into the space between the two end faces of the grinding wheels, then the rotatory center line of the spring is driven to move in a circular locus on the end faces of the grinding wheels by the swinging and moving combined mechanism 5. When the upper grinding wheel 1 is moved downwardly, the two end faces of the spring are ground by the grinding wheels with the spring in a revolving state. When the length of the ground spring meets the requirement, the upper grinding wheel 1 is stopped moving downwardly and is returned to the original point later, then the grinding disc 3 is stopped and the swinging and moving combined mechanism 5 swings the complete spring out of the space between the grinding wheels, i.e., the complete spring is removed. When another complete spring is to be ground, the operator will place the spring into the grinding disc 3 and press the start button, then the grinding will be performed by means of the computer based on the previous process.

The technical effects of this type of grinding principle are as follows:

First, high production efficiency, which is resulted from: 1, the complete spring is ground in the plane of the grinding wheels simultaneously; and 2, at least one of the grinding wheels is configured to comprise an inner grinding wheel and an outer grinding wheel 24 which are rotated in opposite directions, such that the spring can be ground in a revolving state. Thus, a great feeding amount of grinding can be performed. As a result, the production efficiency will be about twice that of the current numerical control spring grinder.

Second, high precision of grinding and high stability: 1, Because every point on the grinding wheels is subjected to equal amount of grinding and the moving locus of the rotatory center line of the spring is a circle whose radius can be regulated, the circle formed by a series of rotatory center lines of the spring on the grinding disc 3 is regulated such that when the spring is moved, the pitch diameter of the spring is exactly tangent to the outer diameter or the inner diameter of the lower grinding wheel 2. In this way, each spring can be ground by every point on the grinding wheels. As a result, the grinding wheels are worn uniformly, improving the precision of grinding of the spring. 1, The spring can be ground in a revolving state, and the grinding forces exerted by the lower inner grinding wheel and outer grinding wheel 24 on the spring are in opposite directions as the lower inner grinding wheel and outer grinding wheel 24 are rotated in different directions. If half of the difference of the outer diameter dimension minus the inner diameter dimension of the lower inner grinding wheel 21 is equal to half of the difference of the outer diameter dimension minus the inner diameter dimension of the lower outer grinding wheel 24 and is less than twice of the pitch diameter of the spring, there are always end faces of the spring that are ground in the plane of the lower inner grinding wheel 21 and also end faces of the spring that are ground in the plane of the lower outer grinding wheel 24, regardless of the movement of the spring in the plane of the grinding wheels. The grinding force exerted on the spring in the plane of the lower inner grinding wheel 21 and the grinding force exerted on the spring in the corresponding plane of the upper grinding wheel 1 are equal in magnitudes and opposite in directions, the resultant moment thereof with respect to the spring revolving is zero. The grinding force exerted on the spring in the plane of the lower outer grinding wheel 24 and the grinding force exerted on the spring in the corresponding plane of the upper grinding wheel 1 are equal in magnitudes and same in directions, the resultant moment thereof with respect to the spring revolving is greater than zero. As long as the design parameters are reasonable, there will finally be a resultant moment on the spring to push the spring to revolve. Therefore, the grinding of the spring in a revolving state can be achieved.

Finally, the present mechanism includes a mechanism having the combination of the two technical features described above, enabling every point on the end faces of the spring to be ground by every point on the grinding wheels, and the grinding wheels are worn particularly uniformly. As a result, the grinding wheels need not to be trimmed and cut from being newly used until being worn out, and the plane of the grinding wheels will always keep a high planarity. Therefore, the vertical precision of grinding of the spring and the stability are greatly improved.

Third, saving energy and protecting the environment as well as achieving a low cost of grinding: 1, Low energy consumption, which is resulted from: the spring is ground in a revolving state, and the texture directions of the end faces of the spring vary constantly during grinding, thus heat on the grinding surface is dissipated fast and not apt to be gathered. As a result, the spring is invulnerable to be burned and is easy to be ground, thus reducing the power consumption. 2, Improved working environment and low cost of grinding, which is resulted from: when grinding the spring, the grinding wheels need not to be trimmed and cut from being newly used until being worn out. The troublesome problem that the grinding wheels are required to be trimmed and cut constantly for the current numerical control spring grinder when it is grinding springs having a steel wire diameter of above 3 mm is solved. As a result, the utilization of the grinding wheels as well as the working environment for the operators are improved, at the same time, the cost of grinding is reduced.

Fourth, achieving a simple structure and a low cost of manufacture: the grinding disc 3 is mounted on the linkage of the swinging and moving combined mechanism 5, and the complete spring is swung into and out of the space between the two end faces of the grinding wheels by means of a support 71 in the swinging and moving combined mechanism 5 (the support 71 is mounted in the lower plane of the gearbox) that is linked with a turntable 73 by a linkage B72, one end of the linkage B72 passing through the shaft pin at the edge of the turntable 73. The motor is decelerated, and the turntable 73 is driven to rotate by the output shaft and the flat key, causing the linkage B72 to make a planar motion by the shaft pin and the bearing. Then the gearbox that is rotated around a pendulum shaft 8 (the gearbox being mounted on the pendulum shaft 8) is swung back and forth, enabling the complete spring to swing into and out of the space between the two end faces of the grinding wheels. The grinding disc 3 is designed such that as long as it is dwelled in swinging-in and swinging-out positions, the linkage A55, point C and the center point of the turntable 73 are exactly collinear. In this way, when the point of linkage A55 is rotated with the turntable 73 to be close to point A or point C, substantially no swinging is happened to the gearbox, i.e., very little swinging is happened, which results in little offset between the center of the grinding disc 3 and the center of the grinding wheels. The design is considered to meet the requirement of the ground spring or the requirement that the grinding disc 3 is swung out to the removing position of the spring. The advantages of this design are as follows: 1, Common motors which are less costly and easily controlled can be selected and used, only if the grinding disc 3 is dwelled in swinging-in or swinging-out positions when the motor is started or stopped, such that A, C and O are collinear, at which time, the gearbox cannot be pushed to swing by the resultant moment generated by the grinding forces of the spring to push the box to swing. With above technical features, the grinding disc 3 can be kept at the desired position when the spring is ground. 2, The turntable 73 is configured to have four shaft pin holes thereon which are different from one another in radius dimensions by about 0.2 mm, such that when the grinding disc 3 is swung into the space between the two grinding wheels and the shaft axes of two slider shafts 54 are adjusted to be collinear with the shaft axes of their matching carriage shafts 53 of the swinging and moving combined mechanism 5, the center line of the grinding disc 3 is substantially coincide with the center line of the grinding wheels. In this way, a mechanism for continuously regulating the magnitude of the swinging angle is not necessary and the usage requirement can be met. Therefore, a simple structure is achieved and the cost of manufacturing is reduced.

Fifth, long persistence in precision of mechanisms and good stability, which is resulted from: the tapered roller bearing 28 that supports the grinding wheel shaft is configured to have a U-shaped spring washer 29 on the end face of its outer ring, and the U-shaped spring washer 29 is equivalent to a spring that can be deformed axially and has a large elastic rigidity. The advantages of this design are as follows: when the mechanisms are mounted and after the interference of the tapered roller bearing 28 is well regulated, to keep the original interference of the tapered roller bearing 28, the U-shaped spring washer 29 pushes the outer ring of the bearing to axially move in order to automatically compensate the wear of the bearing during the use of the mechanisms as the tapered roller bearing 28 is definitely to be worn, achieving the automatic regulation of the interference of the bearing. As a result, the characteristics of long persistence in precision of mechanisms and good stability are achieved.

The above are merely specific embodiments of the present invention, but the design concept of the present invention is not limited to this, and all insubstantial variations of the present invention that utilize this concept should be regarded as behaviors that infringe the protection scope of the present invention.

We claim:

1. A method for grinding a spring with high quality and high efficiency, comprising the steps as follows:

Firstly, at least one of an upper grinding wheel and a lower grinding wheel is configured to comprise an inner grinding wheel and an outer grinding wheel, wherein the inner grinding wheel is fitted in the outer grinding wheel; the inner grinding wheel or the outer grinding wheel is driven by a transmission mechanism, the inner grinding wheel and the outer grinding wheel rotating in opposite directions; after a complete spring is fed to a space between the upper grinding wheel and the lower grinding wheel, the complete spring is moved back and forth in the plane of the grinding wheels; at the same time, the grinding wheels are fed and then withdrawn after the spring is well ground; then, the ground spring movement is stopped and it is moved away from the space between the two grinding wheels, and finally the complete spring is removed.

2. The method for grinding a spring with high quality and high efficiency of claim 1, characterized in that the spring is moved back and forth in the plane of the grinding wheels by means of a swinging and moving combined mechanism that comprises a worm linked with a motor, wherein two worm wheels are provided on both sides of the worm, the worm wheel being linked with a carriage shaft, and a slider shaft is provided on the carriage shaft, the slider shaft being linked with a linkage A that is connected with a grinding disc, the spring being loaded within the grinding disc, and the distance between the shaft axis of the slider shaft and the shaft axis of the carriage shaft can be regulated.

3. The method for grinding a spring with high quality and high efficiency of claim 2, characterized in that the two carriage shafts of the swinging and moving combined mechanism are driven by the two worm wheels, and the two worm wheels are transmitted by the same worm; or the two carriage shafts of the swinging and moving combined mechanism are driven by two gears, and the gears are transmitted by a same gear shaft.

4. The method for grinding a spring with high quality and high efficiency of claim 3, characterized in that the upper grinding wheel comprises an inner grinding wheel and an outer grinding wheel, and the lower grinding wheel has an integral structure; or the lower grinding wheel comprises an inner grinding wheel and an outer grinding wheel, and the upper grinding wheel has an integral structure; or both the lower grinding wheel and the upper grinding wheel comprise an inner grinding wheel and an outer grinding wheel, and with this structure, both inner grinding wheels are rotated in the same direction and both outer grinding wheels are also rotated in the same direction, but the inner grinding wheels and the outer grinding wheels are rotated in opposite directions.

5. The method for grinding a spring with high quality and high efficiency of claim 4, characterized in that the complete spring is fed to a space between the upper grinding wheel and the lower grinding wheel by means of the swinging and moving combined mechanism, and the swinging and moving combined mechanism is configured to comprise a support that is linked with a turntable by a linkage B, one end of the linkage B being provided at the edge of the turntable by a shaft pin.

6. The method for grinding a spring with high quality and high efficiency of claim 5, characterized in that the transmission mechanism comprises a belt pulley that is linked with the motor and a grinding wheel shaft that can be rotated with the belt pulley, the grinding wheel shaft being fixedly connected with the inner grinding wheel or the outer grinding wheel.

7. The method for grinding a spring with high quality and high efficiency of claim 6, characterized in that a inner grinding wheel shaft of a inner grinding wheel is fitted in the outer grinding wheel shaft of the outer grinding wheel with a tapered roller bearing provided between them, and a outer grinding wheel shaft is provided in a bearing sleeve with a tapered roller bearing provided between them as well, and the tapered roller bearing is configured to have a U-shaped spring washer on the end face of its outer ring, the contact surface between the U-shaped spring washer and the tapered roller bearing is of an arc shape.

8. The method for grinding a spring with high quality and high efficiency of claim 7, characterized in that the upper grinding wheel is linked with the motor shaft by an upper coupling and a lower coupling, a coupling plate being provided between the upper coupling and the lower coupling, and the edge of the coupling plate is quartered by four notches.

* * * * *